United States Patent [19]

McDonald et al.

[11] 4,281,828

[45] Aug. 4, 1981

[54] PLASTIC BAG HANDLING SYSTEM

[75] Inventors: James A. McDonald, Palos Heights; Earl F. Stachel, Westmont, both of Ill.

[73] Assignee: Union Carbide Corporation, New York, N.Y.

[21] Appl. No.: 94,422

[22] Filed: Nov. 15, 1979

Related U.S. Application Data

[63] Continuation of Ser. No. 891,829, Mar. 30, 1978, abandoned.

[51] Int. Cl.[3] ..... B65H 45/18

[52] U.S. Cl. ..... 493/12; 493/243; 493/437

[58] Field of Search ..... 270/66-67, 270/69, 83, 80-85; 93/84 R, 84 TW, 8 R, 13, 32

[56] References Cited

U.S. PATENT DOCUMENTS

| | | | |
|---|---|---|---|
| 3,437,334 | 4/1969 | Maldonado | 270/69 |
| 3,578,311 | 5/1971 | Wood | 270/69 |
| 3,611,882 | 10/1971 | Anderson | 93/84 R |
| 3,790,157 | 2/1974 | Crawford | 270/66 |

*Primary Examiner*—Edgar S. Burr
*Assistant Examiner*—A. Heinz
*Attorney, Agent, or Firm*—John C. Le Fever

[57] ABSTRACT

A system for handling and transferring plastic bags between folding stations including control means for monitoring the folding accuracy and alignment of each bag while advancing along a predetermined path and means responsive to the control means for diverting each improperly registered bag from such path.

6 Claims, 10 Drawing Figures

PLASTIC BAG HANDLING SYSTEM

This application is a continuation of U.S. application Ser. No. 891,829 filed Mar. 30, 1978, and now abandoned.

The present invention relates to plastic bag handling systems and more particularly to a system for handling and monitoring the transfer of plastic bags between bag folding stations.

Plastic bags are formed from rolled or sheet stock of thin film of a polymeric composition such as, for example, polyethylene, polyvinyl chloride, polyester and the like. For packaging purposes the bags, once formed, must be properly folded and packaged for disposition within appropriately sized cartons. The number and type of folding operations are related to the relative size between the bag and carton and the selected packaging arrangement. In the case of individually folded plastic bags, each bag is first folded longitudinally at least once and then cross folded. A second cross folding operation may follow or alternatively, particularly for larger size bags, the bag may be rolled about its transverse axis in a jelly roll configuration and flattened. The folding operations are performed in stages all of which are automated and under machine control.

In operation, if a bag has been improperly folded, lies skewed or is otherwise guided out of proper alignment with the machine direction each downstream folding and/or rolling operation will only further serve to excerbate the condition of the bag and invariably result in fouling up the system machinery. The entire system will thereafter have to be shut down and the clogged machinery cleared. The amount of time lost to improperly folded or misaligned bags can be considerable. The bag handling system efficiency is directly proportional to the system running time divided by scheduled time. Accordingly, a substantial increase in system efficiency can be achieved by monitoring the "registration" of each bag in the machine direction at an intermediate stage of bag handling preferably following the first longitudinal folding operation and automatically discarding bags out of proper "registration". For purposes of the present invention the term "registration" shall encompass detection of the alignment of each bag in the machine direction and the measurement of the dimensions of each bag.

It is accordingly the principal object of the present invention to provide an improved system for handling the transfer of plastic bags between folding stations.

It is a further object of this invention to provide an improved system for handling the transfer of plastic bags between folding stations which automatically discards improperly registered bags.

Other objects and advantages of the present invention will become apparent from the following detailed description of the invention when read in conjunction with the accompanying drawings in which.

Figure 1:
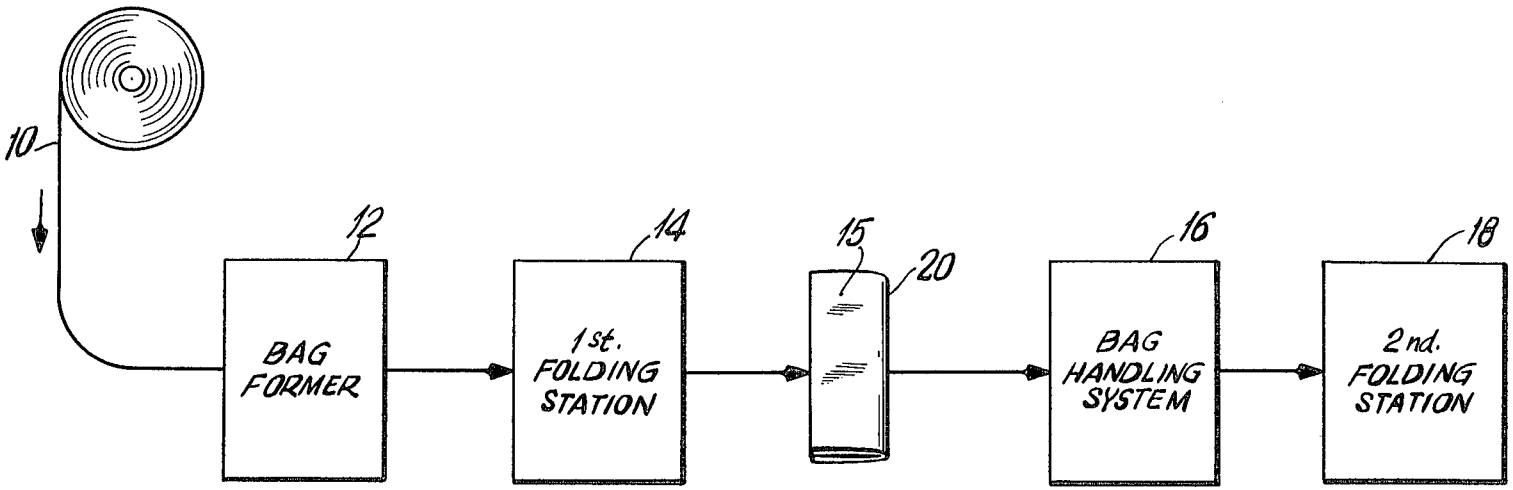
FIG. 1 is a block diagram illustrating a conventional system for forming and folding bags incorporating the bag handling system of the present invention.

Referring now to the block diagram of FIG. 1 which diagrammatically illustrates an automated system for producing and folding bags from a supply of rolled stock of film material 10 composed of any suitable polymeric composition. The bag former 12 may represent any commercially available machine for converting rolled stock of plastic film 10 into a plastic bag of any desired configuration and seam arrangement. A preferred bag is the side seam welded "U" folded bag having a seamless bottom which may be readily formed from rolled stock in a conventional machine such as the Model No. 208 polyethylene bag making machine manufactured by G. T. Schjeldahl Co. U.S.A.

The material 10 is processed into bags 15 for individual handling and packaging. The general procedure followed is to fold the bag 15 about its longitudinal axis, preferably only once, and then to proceed to fold it at least once about its transverse axis from whence it is either directly packaged or rolled and then packaged. The first longitudinal folding operation may be carried out at the first folding station 14 using a commercially available machine such as the Accu-Folder Folding Machine manufactured by the FMC Corporation U.S.A. After the bag 15 is longitudinally folded it is delivered through the bag handling system 16 of the present invention to a second folding station 18. The second folding station 18 may represent an intermediate or final folding operation in the overall automated packaging of the bags 15 which is not the subject of the present invention.

The folded bag 15 is preferably discharged from the first folding station 14 with its creased folded end 20 representing the leading edge. The handling system 16, as is more clearly shown in FIGS. 1–5 inclusive, feeds each folded bag 15, discharged from the first folding station 14 at a predetermined speed into a fence 22 located transverse to the direction of travel for interrupting the movement of the bag 15. Each bag is fed successively by a plurality of corrugating drive rollers 24, 26 arranged in an interdigitating relationship and mounted on an upper and lower drive shaft 28 and 30 respectively. The drive shafts 28 and 30 are driven in common by a motor (not shown). The lateral spacing between the drive rollers 24 and 26 form corrugations in the folded bag 15 with the depth of the corrugations determined by the vertical relationship of the rollers 24 and 26. The vertical position of the drive shafts 28 and 30 are adjustable through adjustment screws 32 and 34 respectively. The speed of rotation of the shafts 28 and 30 controls the linear feed rate of each bag 15.

Each bag 15 is thereafter guided along a predetermined path between an upper and lower row of guide rods 36 and 38 respectively. The upper and lower row of guide rods 36 and 38 lie generally parallel with the direction of travel and are aligned relative to the corrugating drive rollers 26 and 24 so as to maintain the corrugations formed in the folded bag 15 as it moves therethrough. The folded bag 15 advances under the guidance of the rods 36 and 38 until the bag 15 is interrupted by hitting the barrier fence 22.

The fence 22 is divided into two sections 50 and 52 bolted to separate frames 54 and 55. Each section of frame 50 and 52 is made up of a series of fence posts 56 separated by grooves 58 through which the upper guide rods 36 pass. The lower guide rods 38 are connected to the fence posts 56.

Upon hitting the fence 22 the bag 15 comes to rest. A pair of nip rollers 40 and 42 are located between the sections 50 and 52 of the fence 22 for removing the bag from the handling system 16. The nip rollers 40 and 42 form part of the second folding station 18 of FIG. 1 and operates in conjunction with a blast of air from an air knife (not shown). The air blast is in the direction of the arrow and indicated in FIG. 3 and initiates the transverse folding procedure carried out in folding station 18 through the nip rollers 40 and 42. The axis of the rollers 40 and 42 are aligned with the direction of bag travel below the moving bag for cross folding the bag 15 along a predetermined transverse axis 44 which is preferably off center. The transverse folding procedure is a desirable prerequisite to a subsequent coreless rolling operation which may be performed in a machine as shown and described in U.S. Pat. No. 3,671,033. The rolling operation is not part of the present invention.

Figure 4:
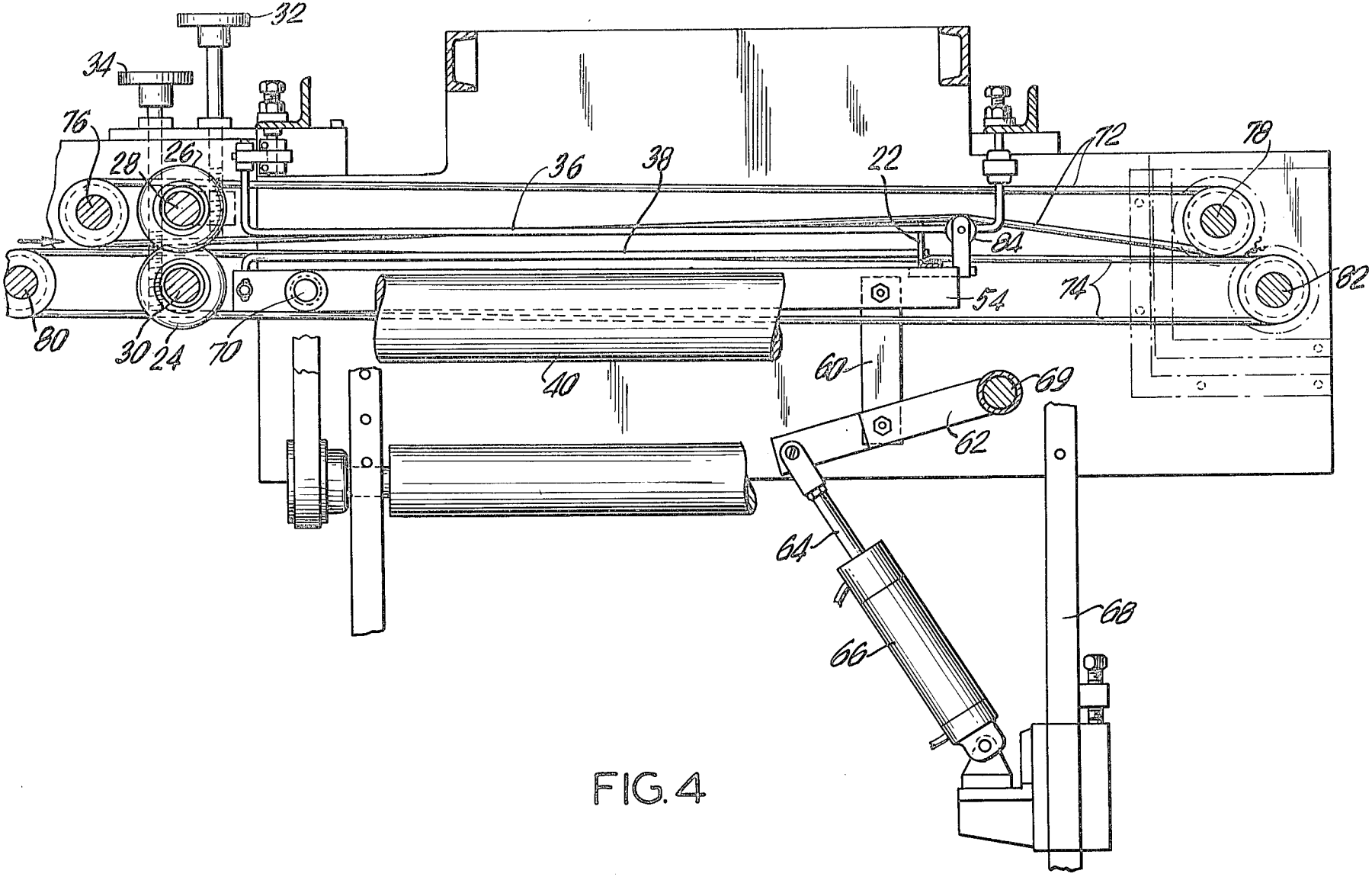
FIG. 4 is a partial side elevation of the system of FIG. 2.
Figure 5:
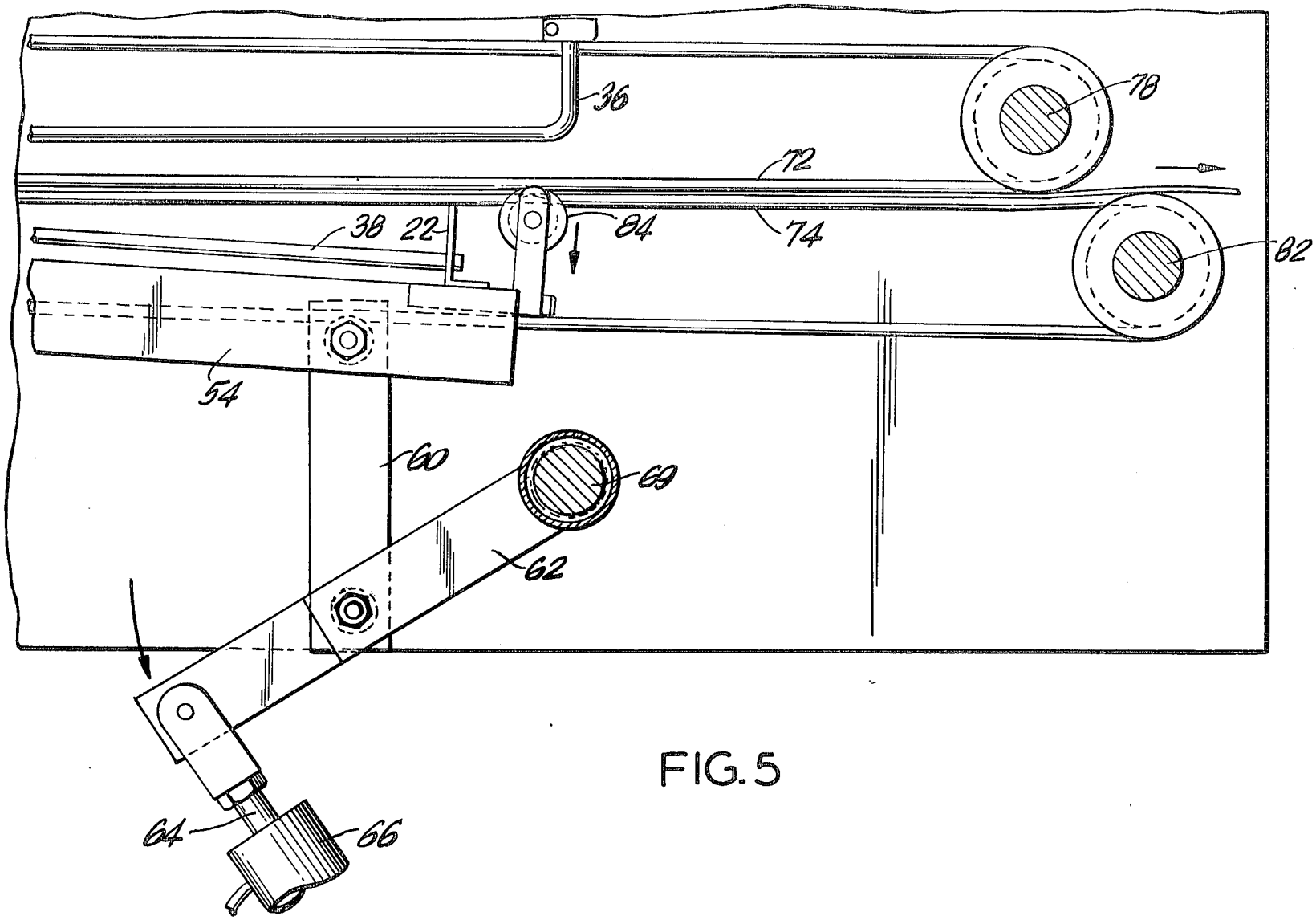
FIG. 5 is an exploded fragmentary view of the fence end of the assembly of FIG. 4 in the operational mode for diverting a bag.

The frames 54 and 55 are adjustably connected through linkage members 60 and 62 to a piston rod 64 extending from a pneumatically operated cylinder 66. The cylinder 66 is connected to a housing 68 which supports the bag handling system 16. The piston rod 64 is shown in FIG. 4 in the fully extended position which is intended to reflect normal operation. If a bag 15 is monitored as being in an improperly registered condition as will be explained hereafter the pneumatically operated cylinder 66 is actuated to retract piston rod 64. As piston rod 64 recedes the linkage member 62 rotates about pivot point 69 moving linkage member 60 downward which in turn causes the frame 54 to rotate downward about pivot point 70 into the position shown in FIG. 5. The downward movement of frames 54 and 55 withdraw the two sections 50 and 52 of fence 22 from the path of travel.

A diverting assembly which comprises a multiplicity of flexible string belts 72, 74 is arranged in parallel rows above and below the path of travel of each bag 15 for ejecting each improperly registered bag from the handling system 16. The upper row of flexible string belts 72 are entrained in a closed loop for endless rotation about shafts 76 and 78. Likewise the lower row of belts 74 are entrained in a closed loop for endless rotation about shafts 80 and 82. The shafts 78 and 82 are driven by a motor (not shown). The upper and lower row of flexible belts 72 and 74 form an endless conveyor system. A set of pulley members 84 are fixedly mounted to the frames 54 and 55 in rotatable engagement with the upper row of string belts 72. When the piston 64 is in the fully extended position shown in FIGS. 3 and 4 inclusive the set of pulleys 84 deflect the upper row of belts 72 away from the path of travel. Alternatively when the piston rod 64 is retracted and the fence withdrawn, the pulleys 84 recede to the position shown in FIG. 5 to permit the upper and lower row of belts 72 and 74 respectively to engage and eject a bag 15 from the handling system 16.

Figure 2:
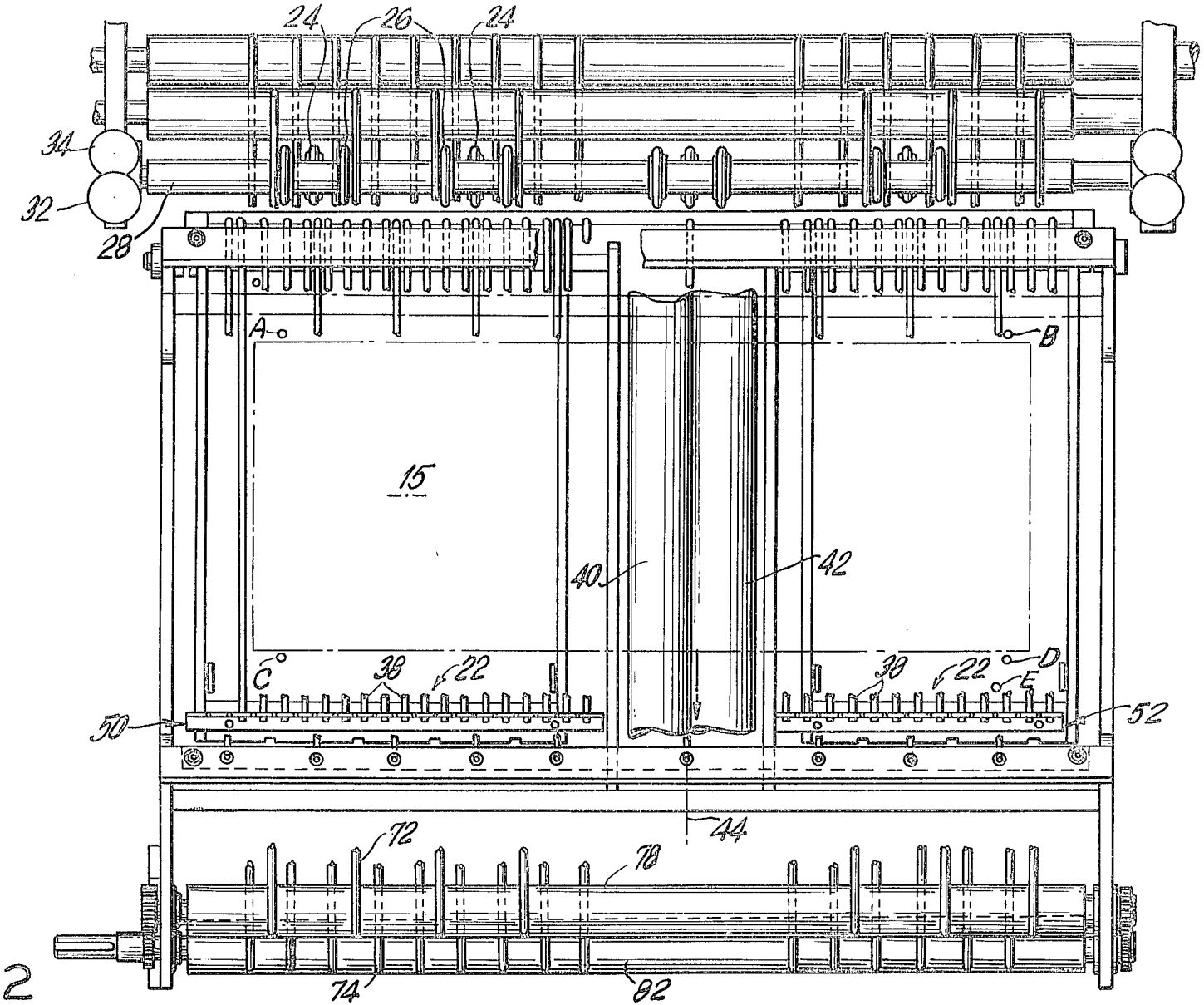
FIG. 2 is a plan view of the bag handling system of the present invention with portions removed for more clearly presenting the operational components of the system.
Figure 3:
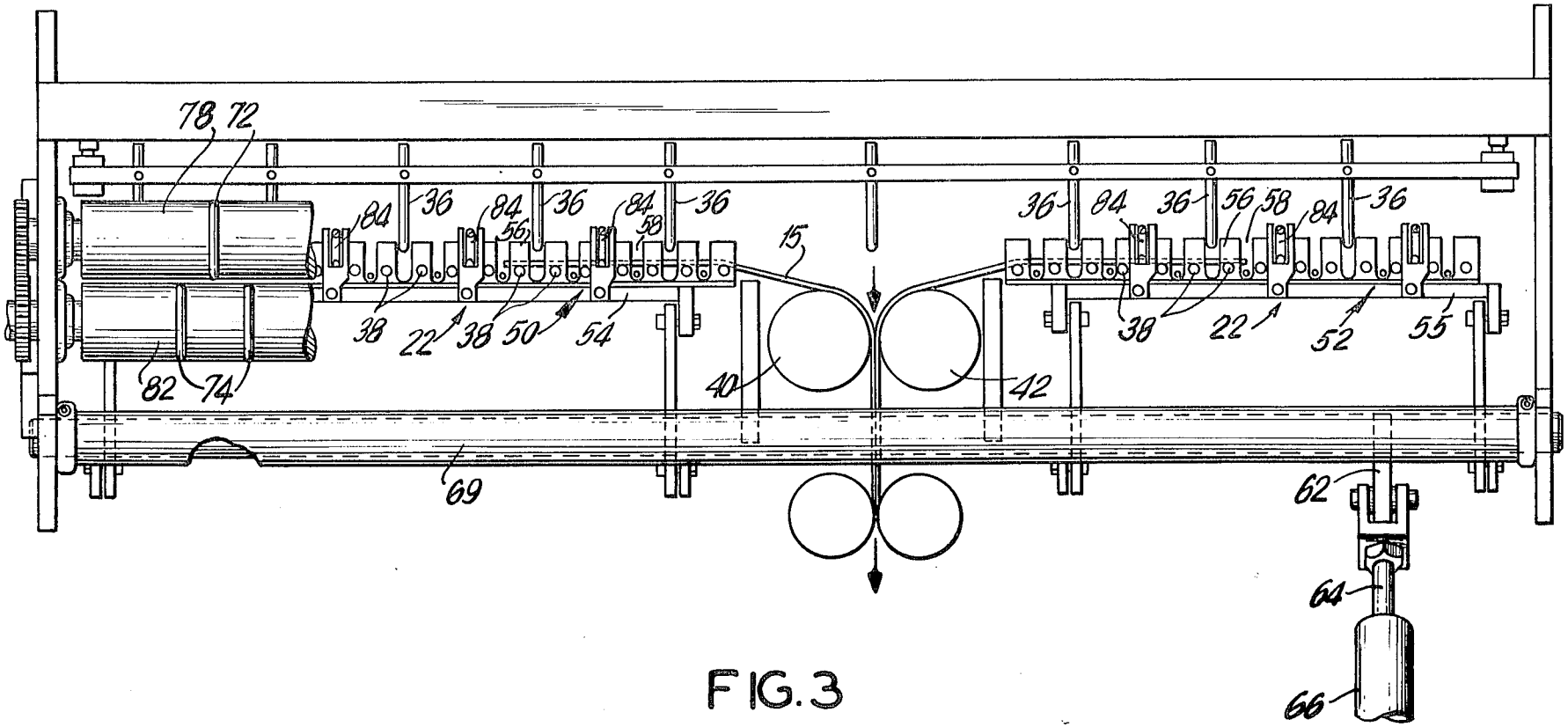
FIG. 3 is an end elevation of the system of FIG. 2 with portions removed to expose relevant operational components of the invention.
Figure 6:
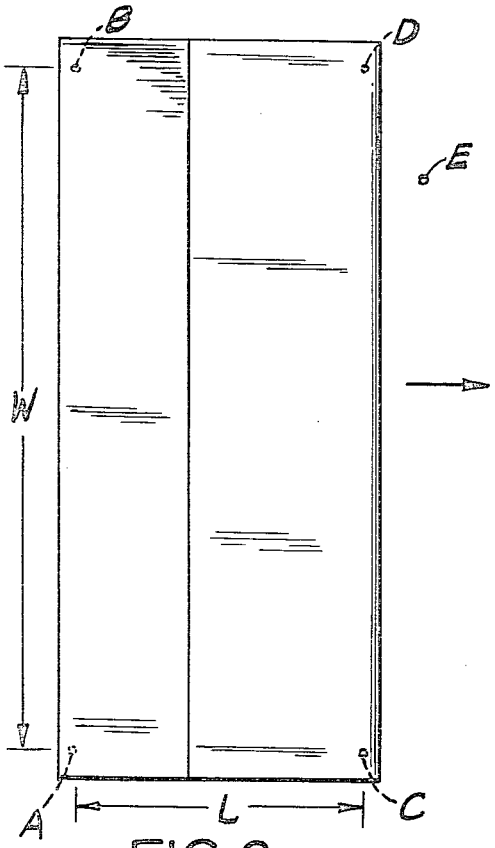
FIG. 6 is a diagrammatic illustration of a bag which has been improperly folded in the first folding station of FIG. 1.

A plurality of phototransducers A, B, C, D and E are mounted upon the housing 68 above the advancing bag 15 in the position indicated in FIG. 2 for monitoring the registration of the bag. The phototransducers A, B, C, D and E may represent any conventional phototransmitter and photodetector arrangement. It is preferred to use a photocell—photodetector device such as, for example, the FE-R3AT scanner of Honeywell, Inc. sold in a single unit for use in combination with reflecting tape. The reflecting tape is located along the line of sight of each phototransducer A, B, C, D and E below the path of travel on any convenient member of the housing 68. The phototransducers A, B, C and D are arranged in a substantially rectangular formation as shown in FIG. 6 upstream of fence 22 with phototransducers A and C spaced apart a distance L jsut slightly greater, by about $\frac{1}{4}$ inch, than the desired dimension for the folded bag 15 in the direction of travel and with phototransducers A and B spaced apart a distance W about $2\frac{1}{2}$ inches less than the dimension transverse the direction of travel of the bag. The phototransducer E is located approximately at the fence 22 along the path of travel.

Figure 7:
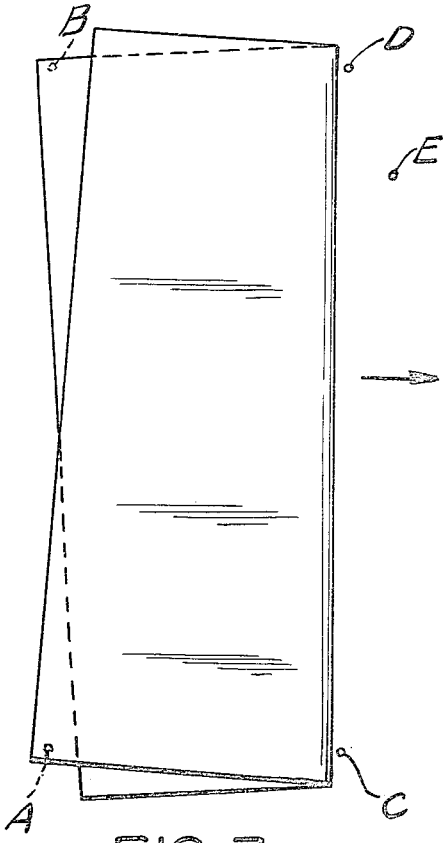
FIG. 7 is a diagrammatic illustration of another improperly folded bag configuration.
Figure 8:
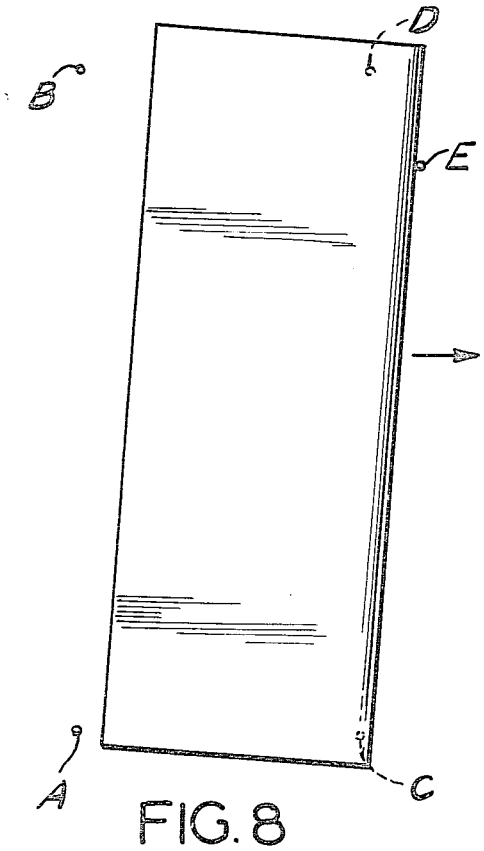
FIG. 8 is a diagrammatic illustration of a folded bag out of proper alignment with the machine direction.
Figure 9:
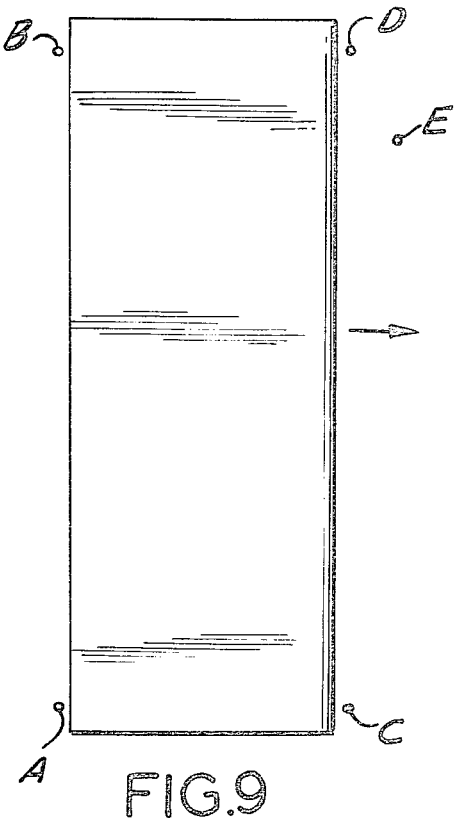
FIG. 9 is a diagrammatic illustration of a properly folded bag in the proper aligned position relative to the second folding station.
Figure 10:
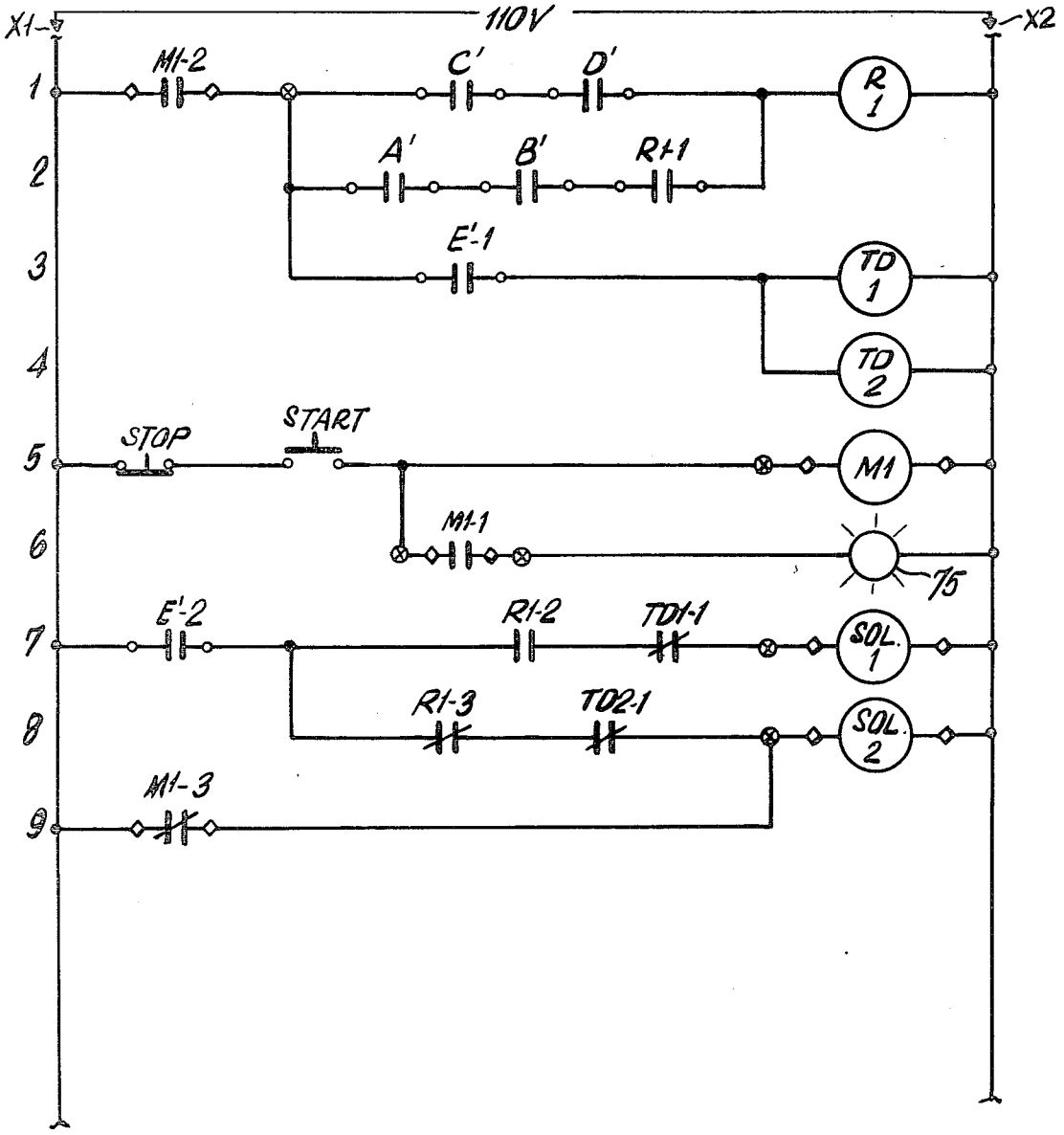
FIG. 10 is a schematic of a photocell control circuit for monitoring the registration of the bag.

An electrical circuit, schematically shown in FIG. 10, operates in conjunction with the phototransducers A, B, C, D and E to control the operation of the fence 22 and the diverting arrangement of flexible string belts. The control circuitry may also be used to control the cross folding operation. As is more readily apparent from FIGS. 6–8, in conjunction with FIG. 10 if the bag 15 is folded improperly such as is shown, for example, in FIG. 7 with a length along the path direction greater than the spacing L between phototransducers A and C then solenoid 2 in FIG. 10 will energize as will be explained in more detail hereafter for retracting the fence 22 and discarding the bag 15. This is also the case for a misaligned bag. The sequence of operation involves depressing the start button which energizes the starting relay coil M1 thereby closing the normally-open relay contacts M1-1 and M1-2 and opening normally closed contact M1-3 respectively. A 110 volt AC supply is connected across the supply lines x1–x2. Upon closing contact M1-1 the light source 75 is energized. The phototransducers A, B, C and D are conventional light operated photocells having normally open contacts A′, B′, C′ and D′ which close when light is being reflected and reopen when light is interrupted. The phototransducer E is a conventional normally open dark operated photocell which opens its contacts E′-1 and E′-2 when light is being reflected and closes its contacts E′-1 and E′-2 when light is interrupted.

In operation, relay R1 is energized through closed contacts C′ and D′ of photocells C and D and is locked in through a circuit containing its own contact R1-1 and the photocontacts A′ and B′. A properly folded bag in proper alignment will first pass under phototransducers A and B and then under phototransducers C and D re-establishing the light beam under A and B before relay R1 is deenergized. Accordingly, when the bag 15 further advances to the fence 22 interrupting the light beam to phototransducer E the solenoid SOL-1 in line 7 will energize through closed photocontact E′-2, closed relay contact R1-2 and normally closed contact TD1-1 of time delay relay TD1. Time delay relay TD1 is an adjustable time delay relay which is set, for example, to time out in 10–15 micro-seconds. Solenoid SOL-1 controls the cross folding of the bag 15 during normal operation when each bag 15 is advancing into the fence 22 properly.

When the bag 15 is of too long a length because of improper folding or is misaligned relay R1 will be allowed to deenergize. This allows relay contact R1-2 to open and relay contact R1-3 to close. Hence solenoid SOL-2 will energize through E'-2, R1-3 and time delay contact TD2-1 of time delay TD2. Time delay TD-2 is another adjustable time delay relay which is preferably set for a time period of, for example, one hundred micro-seconds Solenoid SOL-2 controls the pneumatic cylinder for retracting fence 22.

An alternative and simpler arrangement of photocells would involve merely the removal of photocells A and B as well as line 2 from the circuit of FIG. 10. This leaves only photocells C, D and E and their corresponding photocontacts in FIG. 10. In this case the spacing W should remain about ¼ inch less than the proper width for the bag but should be spaced an equal distance from the fence 22 about ¼ inch more than the proper length of the bag in the machine direction. The circuit of FIG. 10 would operate in a similar fashion deenergizing relay R1 when the bag passes photocells C' and D'. This will occur if the bag is of a length less than about a distance of, for example, ¼ inch above the proper folded length. For example, if the bag should have a folded length of 15 inches, any bag larger than 15.25 inches will be ejected by the energization of solenoid 2.

What is claimed is:

1. A system for handling the transfer of plastic bags from a first folding station, where each plastic bag is folded at least once about a fixed axis, to a second folding station where each bag is folded about a second axis transverse to said first axis; comprising:

means for feeding in succession each bag discharged from said first folding station along a predetermined path in the direction of said second folding station;

means for forming predetermined corrugations in each bag being discharged from said first folding station;

guide means for maintaining said predetermined corrugations during movement of each bag;

means disposed along said path for blocking each bag comprising a substantially upright fence aligned in a direction transverse to said path;

an adjustable frame for supporting said fence;

control means for monitoring the registration of each bag with respect to said path at a location upstream of said second folding station and means connected to said frame for raising and lowering said frame in response to said control means; said control means and said frame raising and lowering means comprising a plurality of photoelectric cells disposed relative to said path in a predetermined arrangement and circuit means responsive to a first predetermined state of energization of said photoelectric cells for maintaining said adjustable frame activated in a raised position when each bag is properly registered and for lowering said frame in response to a second predetermined state of energization of said photoelectric cells when a bag is improperly registered; and means responsive to said control means for diverting each improperly registered bag from said path, comprising: a multiplicity of flexible string belts arranged in substantially parallel rows on opposite sides of said path for engaging a bag in response to said control means, with each belt forming a closed loop for endless rotation; means for continuously driving each string belt; and pulley means connected to said frame for deflecting said flexible string belts from the bag engaged position when said frame is in the raised position and for releasing said belts when said frame is lowered.

2. A system as defined in claim 1 wherein said corrugating means comprises a first and second shaft each having a plurality of rollers arranged in an interdigitating relationship.

3. A system as defined in claim 2 wherein said guide means comprises a multiplicity of guide rods arranged in two rows in a substantially corresponding arrangement to said interdigitating rollers.

4. A system as defined in claim 3 wherein at least one row of guide rods is supported by said adjustable frame.

5. A system for handling the transfer of plastic bags from a first folding station, where each plastic bag is folded at least once about a fixed axis, to a second folding station where each bag is folded about a second axis transverse to said first axis; comprising:

means for feeding in succession each bag discharged from said first folding station along a predetermined path in the direction of said second folding stations;

movable fence means disposed along said path for interrupting the movement of each bag at a location proximate said second folding station;

means for initiating said second folding operation upon the interruption of each bag;

a frame supporting said fence and adjustable between a raised position with said fence disposed in said path to interrupt movement of said bags and a lowered position with said fence withdrawn from said path;

means for monitoring the registration of each bag with respect to said path at a location preceding said fence, comprising sensing means disposed relative to said path in a predetermined arrangement for generating a first predetermined output signal when each bag is properly registered and generating a second predetermined output signal in response to each improperly registered bag;

means responsive to said first predetermined output signal of said sensing means for maintaining said frame activated in said raised position with said fence disposed in said path when each bag is properly registered, and lowering said frame into said lowered position in response to said second predetermined output signal from said sensing means when a bag is improperly registered, to withdraw said fence from said path;

means for diverting each improperly registered bag from said path, comprising: a multiplicity of flexible string belts arranged in substantially parallel rows on opposite sides of said path and deflectable from a bag engaged position to a bag non-engaged position, with each belt forming a closed loop for endless rotation; means for continuously driving each string belt; and means for deflecting said flexible string belts from said bag engaged position to said bag non-engaged position when said frame is in said raised position, and for releasing said belts from said bag non-engaged position to said bag engaged position when said frame is lowered into said lowered position;

whereby said frame is maintained in raised position with said fence disposed in said path and said flexible string belts in said bag non-engaged position during handling of each properly registered bag, and said frame is lowered into said lower position with said fence withdrawn from said path and said flexible string belts in bag engaged position when an improperly registered bag is sensed by said sensing means.

6. A system as defined in claim 5 further comprising:

means for forming predetermined corrugations in each bag being discharged from said first folding station; and guide means for maintaining said predetermined corrugations during movement of each bag until interrupted by said fence means.

* * * * *